US005205945A

United States Patent [19]

Cardis et al.

[11] Patent Number: 5,205,945

[45] Date of Patent: Apr. 27, 1993

[54] MULTIFUNCTIONAL ADDITIVES

[75] Inventors: Angeline B. Cardis, Florence; Arjun K. Goyal, Woodbury; Virginia C. Wiszniewski, Voorhees, all of N.J.

[73] Assignee: Mobil Oil Corporation, Fairfax, Va.

[21] Appl. No.: 779,452

[22] Filed: Oct. 18, 1991

[51] Int. Cl.[5] ..... C10M 133/56; C10M 133/58

[52] U.S. Cl. ..... 252/47.5; 252/402; 548/138; 548/141; 548/520

[58] Field of Search ..... 252/47.5; 548/141, 138, 548/520

[56] References Cited

U.S. PATENT DOCUMENTS

| | | | |
|---|---|---|---|
| 2,760,933 | 8/1956 | Fields et al. | 252/32.7 |
| 4,301,019 | 11/1981 | Horodysky et al. | 252/49.6 |
| 4,584,114 | 4/1986 | Gemmill et al. | 252/47.5 |
| 4,618,438 | 10/1986 | Taukan et al. | 252/47.5 |
| 4,846,984 | 7/1989 | Cardis et al. | 252/47.5 |
| 4,902,804 | 2/1990 | King et al. | 252/47.5 |
| 4,908,144 | 3/1990 | Davis et al. | 252/47.5 |
| 5,110,491 | 5/1992 | Derosa et al. | 252/47.5 |

*Primary Examiner*—Ellen McAvoy
*Attorney, Agent, or Firm*—Alexander J. McKillop; Malcolm D. Keen; Jessica M. Sinnott

[57] ABSTRACT

A multifunctional antioxidant, antiwear and dispersancy additive for fuels and lubricants is a reaction product of a thiol-substituted diazole, such as aminomercaptothiadiazole (AMTD) or dimercaptothiadiazole (DMTD), an aldehyde and a hydrocarbon-substituted succinimide dimer. The succinimide dimer is derived from polyisobutenyl succinimide and tetraethylenepentamine which are reacted in a mole ratio of 2:1.

19 Claims, No Drawings

MULTIFUNCTIONAL ADDITIVES

FIELD OF THE INVENTION

The invention relates to lubricant or fuel additives which have multifunctional antiwear, antioxidant and ashless dispersant properties. More specifically the invention relates to a bissuccinimide supported thiol-substituted diazole which has multifunctional additive properties for lubricants and fuels.

BACKGROUND OF THE INVENTION

In internal combustion engines operating under normal and severe conditions, oil-insoluble particles can form from combustion and lubricant or fuel oxidation by-products. The oxidation products result from the high temperatures and the presence of metals which promote oxidation of the lubricant or fuel. Although antioxidants can prevent the fuel or lubricant from undergoing oxidation, antioxidants are not always fully effective and oxidation by-products are not the only source of contamination. Thus, dispersant and detergent additives are needed which disperse particulate matter and keep metal surfaces clean and free of deposits.

Dispersants are compositions which can facilitate the suspension of fine solid particles to inhibit the agglomeration and accumulation of the particles and their settling out in the fluid. Dispersants may actually break up particle agglomerations and suspend them in the fluid preventing the insoluble matter from forming deposits which will adhere to hot metal parts. Lubricating oils and fuels require dispersants and detergents to reduce or prevent these deposits from forming on internal combustion engine parts and to maintain engine cleanliness.

Alkenyl succinimides are known ashless dispersants for lubricants. It would be desirable to enhance the additive effectiveness of the alkenyl succinimides by giving them antiwear properties.

U.S. Pat. No. 4,584,114 describes ester-aminomercaptothiadiazole adducts as friction reducing and corrosion inhibiting additives for lubricants. Acids from which the esters are derived include succinic acid.

In U.S. Pat. No. 4,301,019 a reaction product of aminomercaptothiadiazole and a hydroxyl-containing unsaturated ester is described as a lubricant additive.

In U.S. Pat. No. 4,846,984 a reaction product of an aminomercaptothiadiazole and a hydrocarbyl epoxide is described as an antiwear and antioxidant enhancing additive for lubricants.

U.S. Pat. No. 2,760,933 discloses a carboxylic ester of a dimercaptothiadiazole as a corrosion inhibitor for lubricating oils.

None of these patents describe the reaction products of the instant invention.

SUMMARY OF THE INVENTION

The invention is directed to a multifunctional additive for lubricants and fuels comprising a reaction product of a hydrocarbon-substituted bissuccinimide, an aldehyde and a thiol-substituted diazole having the structural formula:

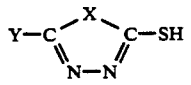

where X is a sulfur atom or oxygen atom and Y is a thiol group or a nitrogenous group, when Y is a nitrogenous group it is a primary amine characterized by the formula $NH_2$ or a secondary amine characterized by the formula $NHR_1$ where $R_1$ is a hydrocarbon group. The invention is also directed to lubricants and fuels containing the additive and methods of making the same.

The invention minimizes and helps to reduce the build-up of engine deposits by dispersing insoluble particles in the fluid media. The additive of the invention also prevents corrosion of metal parts created by the acidic environment to which most engines are exposed. The additives have exhibited wear reducing capability by decreasing the occurrence of wear scars between contacting relatively moving metal parts as compared to a base oil and the base oil containing an equivalent concentration of a known ashless dispersant. The antiwear improvement in the ashless dispersant component, as well as the antioxidant performance is attributed to the thiol-substituted diazole moiety. The alkenyl groups of the succinimide impart solubility to the relatively polar diazole and the dimeric hydrocarbon-substituted succinimide adds, among other things, dispersant and lubricant compatibility properties to the additive.

DETAILED DESCRIPTION OF THE INVENTION

The hydrocarbon-substituted succinimide dimer results from the reaction of two equivalent amounts of a hydrocarbon-substituted succinimide anhydride with one molar amount of an alkylenepolyamine. The hydrocarbon-substituted succinimide dimer is represented by the following structural formula:

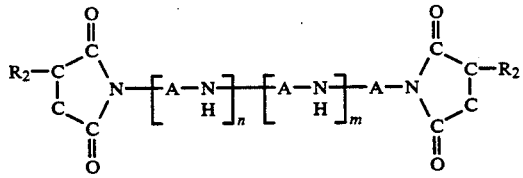

Where $R_2$ is a hydrocarbon such as a monomer or polymer of an alkyl or alkenyl group containing 1 to 250 carbon atoms, preferably 12 to 220 carbon atoms. The alkenyl group is preferably aliphatic which can be saturated or unsaturated and may be straight chain or branched chain. A is an alkyl group containing 1 to 10 carbon atoms, n ranges from 0–7 and m ranges from 1 to 8.

The hydrocarbon-substituted succinic anhydrides are made by known techniques from the reaction of an olefin and maleic anhydride. Suitable olefins include ethylene, propylene, butylene, isobutylene, pentylene, heptylene, decylene, dodecylene, eicosene, higher olefinic hydrocarbons as well as polymers and copolymers made from any of the foregoing olefins. The olefin can also contain cyclic hydrocarbyl groups such as phenyl, naphthyl or alicycle. In order for the final product to have the solubility properties necessary in lubricants the polyalkenyl group should have an average molecular weight ranging from 140 to 3000, preferably from 140 to 2500, more specifically, from 140 to 2000. Hence, although polyisobutylene is a particularly preferred substituent, other substituents can be polypropylene, other polyolefins, as well as monomeric olefins such as dodecenyl.

The alkylenepolyamines from which the hydrocarbyl succinimide dimers are derived can be represented by the structural formula:

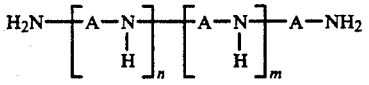

where A is an alkylene group, n and m are integers where n ranges from 0 to 7 and m ranges from 1 to 8. Specific representative examples of suitable alkylenepolyamines from which the hydrocarbylsuccinimides are derived include ethyleneamines such as diethylenetriamine, triethylenetetraamine, tetraethylenepentamine and pentaethylenehexamine, higher polyethylenepolyamines and mixtures thereof. Other alkylenepolyamines and polyalkylene polyamines i.e., polypropylene polyamines can be employed.

Additionally contemplated polyamines are the aromatic polyamines, for example phenylenepolyamines in which there is at least one aromatic group substituted directly onto an amine group or in which the alkylene group is part of an aromatic system, an example of a suitable phenylenepolyamine is aminophenylenediamine. It is contemplated that heterocyclic amines can also be used. Suitable heterocyclic amines are characterized by the presence of an amine bound to a cyclic system containing at least one heteroatom which is oxygen, nitrogen or sulfur. Such a heterocyclic amine will be part of the aromatic polyamine or alkylenepolyamine, either as a substituent of an amine group or substituted onto the alkylene group. An example of a suitable heterocyclic amine is diaminoethylpiperazine. Mixtures of any of these amines can also be used successfully. It is essential that the polyamine contain at least 2 primary amines each capable of reacting with an anhydride and at least one reactive nitrogen atom capable of reacting with the diazole via the aldehyde linking group.

Certain aldehydes which are suitable can be represented by the following structural formula:

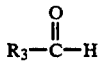

where $R_3$ is a hydrogen atom or a hydrocarbon group containing 1 to 60 carbon atoms which may be alkyl, aryl, alkylaryl or arylalkyl. The hydrocarbon groups can contain 2 to 60 carbon atoms and at least one heteroatom such as an oxygen atom, sulfur atom or nitrogen atom. Typical compounds would be, but are not limited to, the following examples which include formaldehyde, butylaldehyde, salicylaldehyde, acetaldehyde, propionaldehyde, benzaldehyde, hexaldehyde and heptaldehyde. A formaldehyde precursor such as paraformaldehyde, a linear poly(oxymethylene glycol), can also be used. Although ketones may be slower reacting it is believed that they will be suitable reactants. Ketones include acetone, diethylketone, methyl-ethylketone, and 2-ethylhexanone. These compounds are readily available from commercial sources or are easily made using known methods.

The thiol-substituted diazole reactant is characterized by the structural formula:

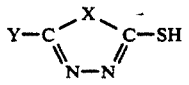

where X is a sulfur atom or oxygen atom and Y is a thiol group or a nitrogenous group, when Y is a nitrogenous group it is a primary amine characterized by the formula $NH_2$ or a secondary amine characterized by the formula $NHR_1$ where $R_1$ is a hydrocarbon group. $R_1$ can be an alkyl, aryl, aralkyl or alkylaryl group containing 1 to 60 carbon atoms. Representative examples of compounds contemplated include 5-amino-2-mercapto-1,3,4-thiadiazole (AMTD) and 2,5-dimercapto-1,3,4-thiadiazole (DMTD).

The hydrocarbon-substituted succinic anhydride is reacted with the alkylenepolyamine or mixture of alkylenepolyamines in order to form the hydrocarbon-substituted succinimide ashless dispersant component. The alkylenepolyamine contemplated has at least 2 primary amine groups which are necessary for forming the hydrocarbon-substituted succinimide dimer.

To prepare the hydrocarbon-substituted succinimide from the succinic anhydride and the polyamine, one or more succinic anhydrides and one or more polyamines are contacted at an elevated temperature, optionally, in the presence of a solvent or diluent inert to the reactants. The temperature conditions can range from about 80° C. to about 300° C., the preferred temperature ranging from 100° C. to 300° C. The reactants are contacted in proportion sufficient to provide one primary amine for each mole of the anhydride which form the bissuccinamide. The bissuccinamide is thereafter converted to the imide form of the compound by heating to a temperature of at least 100° C. which removes the water leaving the desired imide.

In conducting the synthesis reaction the hydrocarbon-substituted succinimide is reacted with the aldehyde and the thiol-substituted diazole in proportions expressed in terms of mole ratios ranging from 1:0.1:0.1 to 1:x:y where x representing the amount of the aldehyde, 1:1:n where y, representing the amount of the diazole, is equal to the number of reactive nitrogen atoms in the bissuccinimide which are available for reaction with the thiol-substituted diazole. Preferably the reactants are contacted in proportion expressed in terms of mole ratios of bissuccinimide : aldehyde : thiol-substituted diazole of 1:2:2. The temperature of the reaction is at least 80° C., ranging from 80° to 155° C., preferably from 85° to 110° C.

Since this is a condensation reaction, the amount of water of reaction can be monitored to facilitate determining the completion of the reaction. Any inert solvent can be used to azeotropically remove the water of reaction, alternatively a vacuum can be used to remove the water. Preferably, however, a solvent is used, suitable solvents being benzene, toluene or xylenes.

The reaction synthesis and structure of one embodiment of the invention, where the succinimide dimer, the aldehyde and the diazole are reacted in a molar ratio of 1:1:1, is illustrated in the following equations:

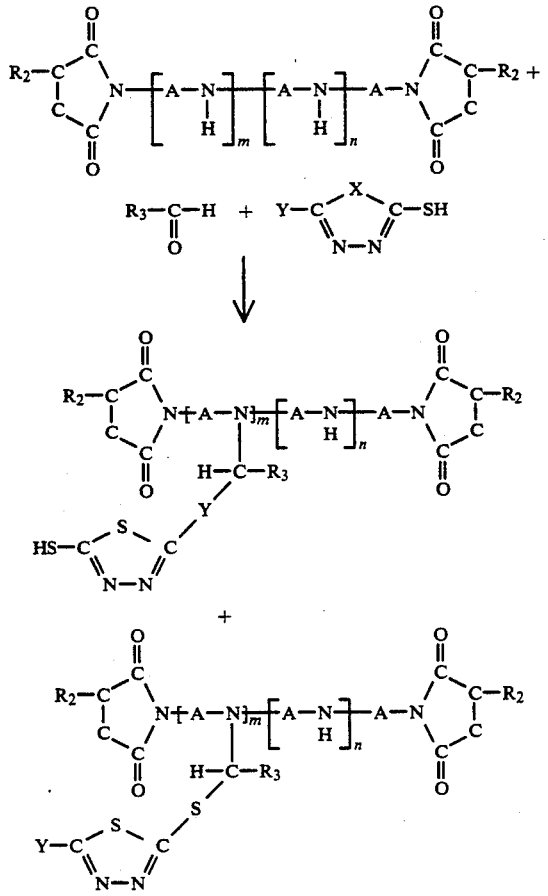

Where $R_2$, $R_3$ and A, Y, n and m are as described above.

The reaction products can be blended with lubricants in a concentration of about 0.05% to 15% preferably, from 0.1% to 10% by weight of the total composition.

The contemplated lubricants are liquid oils in the form of either a mineral oil or synthetic oil or mixtures thereof. Also contemplated are greases in which any of the foregoing oils are employed as a base. Additional materials which it is believed would benefit from the reaction products of the present invention are fuels.

In general, the mineral oils, both paraffinic and naphthenic and mixtures thereof can be employed as a lubricating oil or as the grease vehicle. The lubricating oils can be of any suitable lubrication viscosity range, for example, from about 45 SUS at 100° F. to about 6000 SUS at 100° F., and preferably from about 50 to 900 SUS at 100° F. These oils may have viscosity indexes to 100 or higher.

Where the lubricant is employed as a grease, the lubricant is generally used in an amount sufficient to balance the total grease composition, after accounting for the desired quantity of the thickening agent, and other additive components included in the grease formulation. A wide variety of materials can be employed as thickening or gelling agents. These can include any of the conventional metal salts or soaps, such as calcium, or lithium stearates or hydroxystearates, which are dispersed in the lubricating vehicle in grease-forming quantities in an amount sufficient to impart to the resulting grease composition the desired consistency. Other thickening agents that can be employed in the grease formulation comprise the non-soap thickeners, such as surface-modified clays and silicas, aryl ureas, calcium complexes and similar materials. In general, grease thickeners can be employed which do not melt or dissolve when used at the required temperature within a particular environment; however, in all other respects, any material which is normally employed for thickening or gelling hydrocarbon fluids for forming greases can be used in the present invention.

The lubricating oils and greases contemplated for blending with the reaction product can also contain other additives generally employed in lubricating compositions such as corrosion inhibitors, co-detergents, co-extreme pressure agents, viscosity index improvers, friction reducers, co-antiwear agents and the like. Representative of these additives include, but are not limited to phenates, sulfonates, imides, heterocyclic compounds, polymeric acrylates, amines, amides, esters, sulfurized olefins, succinimides, succinate esters, metallic detergents containing calcium or magnesium, arylamines, hindered phenols and the like.

The additives are most effective when used in industrial applications, such as in circulation oils and steam turbine oils, gas turbines, both heavy-duty gas turbines and aircraft gas turbines, way lubricants, mist oils and machine tool lubricants.

Engine oils are also contemplated such as diesel engine oils, i.e., those used in marine diesel engines, locomotives, power plants and high speed automotive diesel engines, gasoline burning engines and compressors.

Functional fluids also benefit from the present additives. These fluids include automotive fluids such as automatic transmission fluids, power steering fluids and power brake fluids.

Gear oils are another class of fluids which would benefit from the additives of the present invention. Typical of such oils are automotive spiral-bevel and worm-gear axle oils which operate under extreme pressures, load and temperature conditions, hypoid gear oils operating under both high speed, low-torque and low-speed, high torque conditions.

It is believed that the additives can also be successfully utilized in fuels, the fuels contemplated are liquid hydrocarbon and liquid oxygenated fuels such as alcohols and ethers. The additives can be blended in a concentration from about 25 to about 500 pounds of additive per 1000 barrels of fuel. The liquid fuel can be a liquid hydrocarbon fuel or an oxygenated fuel or mixtures thereof. Liquid hydrocarbon fuels include gasoline, fuel oils, diesel oils and alcohol fuels include methyl and ethyl alcohols and ethers such as tert-amyl-methyl ether and methyl-tert butyl ether.

Specifically, the fuel compositions contemplated include gasoline such as a mixture of hydrocarbons boiling in the gasoline boiling range which is from about 90° F. to about 450° F. This base fuel may consist of straight chains or branched chains or paraffins, cycloparaffins, olefins, aromatic hydrocarbons, or mixtures thereof. The base fuel can be derived from among others, straight run naphtha, polymer gasoline, alkylate natural gasoline or from catalytically cracked or thermally cracked hydrocarbons and catalytically cracked reformed stock. The composition and octane level of the base fuel are not critical and any conventional motor fuel base can be employed in the practice of this invention. Further examples of fuels of this type are petroleum distillate fuels having an initial boiling point from about 75° F. to about 135° F. and an end boiling point from about 250° F. to about 750° F. It should be noted in this respect that the term distillate fuels is not intended to be restricted to straight-run distillate fractions. These distillate fuel oils can be straight-run distillate fuel oils catalytically or thermally cracked (including hydrocracked) distillate fuel oils etc. Moreover, such fuel oils can be treated in accordance with well-known commercial methods, such as acid or caustic treatment, dehydrogenation, solvent refining, clay treatment and the like.

Particularly contemplated among the fuel oils are Nos. 1, 2 and 3 fuel oils used in heating and as Diesel fuel oils, gasoline, turbine fuels and jet combustion fuels.

The fuel compositions of the instant invention may additionally comprise any of the additives generally employed in fuel compositions. Thus, compositions of the instant invention may additionally contain conventional carburetor detergents, anti-knock compounds such as tetraethyl lead, anti-icing additives, upper cylinder and fuel pump lubricity additives and the like.

The following examples described the invention in more complete detail.

EXAMPLE 1

To 290 g (0.1 mol) of a bissuccinimide of tetraethylenepentamine bearing polyisobutylene substituents on each succinic acid moiety such that the total molecular weight is 2900 was added 13.3 g (0.1 mol) of aminomercaptothiadiazole (AMTD) and 3.3 g (0.11 mol) of paraformaldehyde, and 150 ml of toluene, in a 2L reactor. The reactor was equipped with a mechanical stirrer, $N_2$ inlet, thermometer and condenser with Dean-Stark trap. The mixture was heated to 130° C. for 3 hours during which time water (1.9 ml) was azeotropically removed. Heating was continued for an additional 2 hours after all the $H_2O$ had come off. The solvent was removed by rotary evaporation and the resulting brown viscous liquid was filtered through celite.

EXAMPLE 2

To 290 g (0.1 mol) of a bissuccinimide of tetraethylenepentamine bearing polyisobutylene substituents on each succinic acid moiety such that the total molecular weight is 2900 was added 26.6 g (0.2 mol) of aminomercaptothiadiazole (AMTD) and 6.3 g (0.21 mol) of paraformaldehyde, and 150 ml of toluene, in a 2L reactor. The reactor was equipped with a mechanical stirrer, $N_2$ inlet, thermometer and condenser with Dean-Stark trap. The mixture was heated to 130° C. for 3 hours during which time water (3.8 ml) was azeotropically removed. Heating was continued for an additional 2 hours after all the $H_2O$ had come off. The solvent was removed by rotary evaporation and the resulting brown viscous liquid was filtered through celite.

EVALUATION OF THE PRODUCT

The reaction product was blended in a concentration of 1 wt % in a 200" solvent paraffinic neutral base stock oil and evaluated for antioxidant performance in the Catalytic Oxidation Test at 325° F. for 40 hours (Table 1) and at 325° F. for 72 hours (Table 2).

The thermal and oxidative stability of the additives were also tested in a fully formulated marine diesel lubricant at 4% additive concentration which is exposed to more severe conditions. The test was run under the hotter, more rigorous conditions typical of a marine diesel lubricant is exposed. In Table 3 the results of the catalytic oxidation test run at 375° F. for 24 hours are presented.

The Catalytic Oxidation Test procedure consisted of subjecting a volume of the test lubricant to a stream of air which was bubbled through the test composition at a rate of about 5 liters per hour for the specified number of hours and at the specified temperature. Present in the test composition were metals frequently found in engines, namely:

1) 15.5 square inches of a sand-blasted iron wire;
2) 0.78 square inches of a polished copper wire;
3) 0.87 square inches of a polished aluminum wire; and
4) 0.107 square inches of a polished lead surface.

The results of the test were presented in terms of change in kinematic viscosity (ΔKV) and change in neutralization number (ΔTAN). Essentially, the small change in KV meant that the lubricant maintained its internal resistance to oxidative degradation under high temperatures, the small change in TAN indicated that the oil maintained its acidity level under oxidizing conditions.

TABLE 1

Catalytic Oxidation Test of a 200" solvent paraffinic neutral base oil 325° F., 40 Hours

| Additive | % Δ KV | Δ TAN |
|---|---|---|
| None | 216 | 11.90 |
| Example 1 (1 wt. %) | 115 | 4.72 |
| Example 2 (1 wt. %) | 117 | 4.13 |

TABLE 2

Catalytic Oxidation Test of a 200" solvent paraffinic neutral base oil 325° F., 72 Hours

| Additive | % Δ KV | Δ TAN |
|---|---|---|
| None | 283 | 17.55 |
| Example 1 (1 wt. %) | 121 | 6.47 |
| Example 2 (1 wt. %) | 121 | 9.31 |

TABLE 3

Catalytic Oxidation Test of a fully formulated marine diesel lubricant 375° F., 24 Hours

| Additive | % Δ KV |
|---|---|
| None | 133 |
| Example 1 (4 wt. %) | 94 |
| Example 2 (4 wt. %) | 94 |

The products of the Examples were also tested for their ability to resist corrosion of copper in the Copper Strip Corrosivity Test. The test consisted of immersing a polished copper strip in a given quantity of a sample of the test composition. The sample was heated to 482° F. At the end of 3 hours the copper strip was removed, washed and compared with the ASTM Copper Strip Corrosion Standards. The Corrosion Standards consisted of color reproductions of typical test strips representing increasing degrees of tarnish and corrosion which were noted in accordance with four specific classifications which ranged from 1, the highest score representing slight tarnish, to 4, the lowest score representing actual corrosion. The letter rating designates the color of the strip corresponding to the classification. The corrosivity ratings attained by the test compositions are reported in Table 4. The test sample containing the product of Example 1 achieved a IA rating and the test sample containing the product of Example 2 achieved a IA rating These ratings corresponded to the IA rating achieved by the base oil without any additive indicating that the products of the examples did not promote any greater degree of corrosion to copper than the unadditized base lubricant.

TABLE 4

Copper Strip Corrosivity Test of a 200" solvent paraffinic neutral base stock 250° C., 3 Hours

| Additive | Copper Strip Rating |
|---|---|
| None | 1A |
| Example 1 | 1A |
| Example 2 | 1A |

The ability of the oil containing the additives of the present invention to prevent the wearing down of metal parts under severe operating conditions was tested in the 4-Ball Wear Test. The results of the test are presented in Tables 5 and 6. Following the standard ASTM testing procedure, the test was conducted in a device comprising four steel balls, three of which were in contact with each other in one plane in a fixed triangular position in a reservoir containing the test sample. The fourth ball was above and in contact with the other three. The fourth ball was rotated at 2000 rpm while under an applied load of 40 kg (Table 5) and 60 kg (Table 6), it was pressed against the other three balls, the pressure was applied by weight and lever arms. The tests were conducted at 200° F. for 30 minutes. The diameter of the scar on the other three lower balls was measured with a low power microscope and the average diameter measured in two directions on each of the three lower balls was taken as a measure of the antiwear characteristics of the test composition. Table 5 shows the marked decrease in wear scar diameter obtained with respect to the test composition containing the products of the Examples. The base oil, an 80/20 mixture of a 150" solvent paraffinic bright stock and a 200" solvent paraffinic neutral base stock was blended with 1% by weight of the products of Examples 1 and 2 as well as a commercial bissuccinimide ashless dispersant. As demonstrated by the results of the test, the additives of the instant invention not only enhanced the antiwear characteristics of the ashless dispersant but reduced the wear of the ball relative to the base oil.

TABLE 5

4-Ball Wear Scar Test of a 80/20 mixture of a 150" solvent paraffinic bright and a 200" solvent paraffinic neutral base stock 40 kg applied load, 2000 rpm, 200° F., 30 minutes

| Additive | Wear Scar (mm) |
|---|---|
| None | 0.604 |
| Commercial ashless dispersant | 1.988 |
| Example 1 | 0.488 |
| Example 2 | 0.500 |

TABLE 6

4-Ball Wear Scar Test of a 80/20 mixture of a 150" solvent paraffinic bright and a 200" solvent paraffinic neutral base stock 60 kg applied load, 2000 rpm, 200° F., 30 minutes

| Additive | Wear Scar (mm) |
|---|---|
| None | 2.388 |
| Commercial ashless dispersant | 2.589 |
| Example 1 | 0.854 |
| Example 2 | 0.771 |

What is claimed is:

1. A multifunctional additive for lubricants comprising a reaction product of a hydrocarbon-substituted succinimide dimer, an aldehyde and a thiol-substituted diazole, the thiol-substituted diazole having the structural formula:

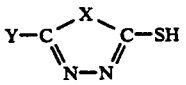

where X is a sulfur atom or oxygen atom and Y is a thiol group or nitrogenous group when Y is a nitrogenous group it is a primary amine characterized by the formula $NH_2$ or a secondary amine characterized by the formula $NHR_1$, wherein R1 is a hydrocarbon group containing 1 to 60 carbon atoms.

2. A multifunctional additive for lubricants comprising the reaction product of claim 1 in which the hydrocarbon-substituted succinimide dimer is derived from two equivalent amounts of a hydrocarbon-substituted succinic anhydride and one molar amount of an alkylenepolyamine compound having the following structural formula

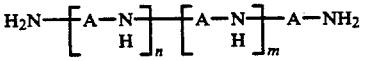

where A is an alkylene group, n and m are integers, n ranging from 0 to 7 and m ranging from 1 to 8.

3. A multifunctional additive for lubricants comprising the reaction product of claim 2 in which the hydrocarbon-substituted succinic anhydride is derived from maleic anhydride and an olefin selected from the group consisting of ethylene, propylene, isopropylene, butylene, isobutylene, pentylene, hexylene, heptylene, decylene, dodecylene and eicosene, higher olefinic hydrocarbons, polymers of said olefins and copolymers of said olefins.

4. A multifunctional additive for lubricants comprising the reaction product of claim 3 in which the alkylenepolyamine is diethylenetriamine, triethylenetetramine, tetraethylenepentamine or pentaethylenehexamine.

5. A multifunctional additive for lubricants comprising the reaction product of claim 1 in which the hydrocarbon-substituted succinimide dimer is derived from two equivalent amounts of the reaction product of a hydrocarbon-substituted succinic anhydride and one molar amount of an amine selected from the group consisting of aromatic polyamines, in which at least one aromatic group is substituted directly onto the amine group, phenylenealkyleneamines in which the alkylene group is part of an aromatic system and heterocyclic amines in which the amine group is bound to a cyclic system containing at least one heteroatom which is oxygen, sulfur or nitrogen and the heterocyclic amine is a substituent of an alkylenepolyamine or phenylenepolyamine.

6. A multifunctional additive for lubricants comprising the reaction product of claim 1 in which the aldehyde is paraformaldehyde, formaldehyde, salicylaldehyde, acetaldehyde, propionaldehyde, benzaldehyde, butyraldehyde, hexaldehyde, and heptaldehyde.

7. A multifunctional additive for lubricants comprising the reaction product of claim 1 in which the thiol-substituted diazole is 5-amino-2-mercapto-1,3,4-thiadiazole and 2,5-dimercapto-1,3,4-thiadiazole.

8. The reaction product of claim 1 in which the hydrocarbon-substituted succinimide dimer, the aldehyde and the thio-substituted diazole are reacted in proportions expressed in terms of mole ratios ranging from 1:0.1.:0.1 to 1:x:y where x represents the amount of the aldehyde and y represents the amount of the diazole, where x and y are each equal to the number of reactive nitrogen atoms in the succinimide dimer which are available for reaction.

9. A lubricant composition comprising a major amount of a lubricant and a minor additive amount of a reaction product of a hydrocarbon-substituted succinimide dimer, an aldehyde and a thiol-substituted diazole, the thiol-substituted diazole having the structural formula:

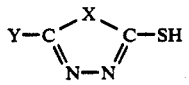

where X is a sulfur atom or oxygen atom and Y is a thiol group or nitrogenous group where Y is a nitrogenous group it is a primary amine characterized by the formula $NH_2$ or a secondary amine characterized by the formula $NHR_1$, wherein R1 is a hydrocarbon group containing 1 to 60 carbon atoms.

10. The composition of claim 9 in which the hydrocarbon-substituted succinimide dimer is derived from two equivalent amounts of a hydrocarbon-substituted succinic anhydride and one molar amount of an alkylenepolyamine compound having the following structural formula

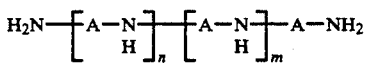

where A is an alkylene group, n and m are integers, n ranging from 0 to 7 and m ranging from 1 to 8.

11. The composition of claim 10 in which the hydrocarbon-substituted succinic anhydride is derived from maleic anhydride and an olefin selected from the group consisting of ethylene, propylene, isopropylene, butylene, isobutylene, pentylene, hexylene, heptylene, decylene, dodecylene and eicosene, higher olefinic hydrocarbons, polymers of said olefins and copolymers of said olefins.

12. The composition of claim 11 in which the alkylenepolyamine is diethylenetriamine, triethylenetetramine, tetraethylenepentamine or pentaethylenehexamine.

13. The composition of claim 9 in which the hydrocarbon-substituted succinimide dimer is derived from two equivalent amounts of the reaction product of a hydrocarbon-substituted succinic anhydride and one molar amount of an amine selected from the group consisting of aromatic polyamines, in which at least one aromatic group is substituted directly onto the amine group, phenylenealkyleneamines in which the alkylene group is part of an aromatic system and heterocyclic amines in which the amine group is bound to a cyclic system containing at least one heteroatom which is oxygen, sulfur or nitrogen and the heterocyclic amine is a substituent of an alkylenepolyamine or phenylenepolyamine.

14. The composition of claim 9 in which the aldehyde is paraformaldehyde, formaldehyde, salicylaldehyde, acetaldehyde, propionaldehyde, benzaldehyde, butyraldehyde, hexaldehyde, and heptaldehyde.

15. The composition of claim 9 in which the thiol-substituted diazole is 5-amino-2-mercapto-1,3,4-thiadiazole and 2,5-dimercapto-1,3,4-thiadiazole.

16. The composition of claim 9 in which the lubricant is a mineral oil, synthetic oil or mixture thereof and the additive is used in a concentration based on the total weight of the composition ranging from 0.05 wt % to 15 wt %.

17. The reaction product of claim 9 in which the hydrocarbon-substituted succinimide dimer, the aldehyde and the thio-substituted diazole are reacted in proportions expressed in terms of mole ratios ranging from 1:0.1.:0.1 to 1:x:y where x represent the amount of the aldehyde and y represents the amount of the diazole, where x and y are each equal to the number of reactive nitrogen atoms in the succinimide dimer which are available for reaction.

18. A method of making a lubricant composition comprising blending a major proportion of a lubricant and a minor amount of a reaction product of a hydrocarbon-substituted succinimide dimer, an aldehyde and an thiol-substituted diazole, the thiol-substituted diazole having the structural formula:

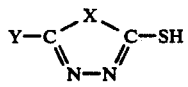

where X is a sulfur atom or oxygen atom and Y is a thiol group or nitrogenous group where Y is a nitrogenous group it is a primary amine characterized by the formula $NH_2$ or a secondary amine characterized by the formula $NHR_1$, wherein R1 is a hydrocarbon group containing 1 to 60 carbon atoms.

19. The method of claim 18 in which the thiol-substituted diazole is 5-amino-2-mercapto-1,3,4-thiadiazole or 2,5-dimercapto-1,3,4-thiadiazole.

* * * * *